US006161255A

United States Patent [19]

Garrett

[11] Patent Number: 6,161,255

[45] Date of Patent: Dec. 19, 2000

[54] PRESSURE HINGE DEVICE FOR GLASS DOOR OR PANEL

[75] Inventor: Rodney G. Garrett, Fort Madison, Iowa

[73] Assignee: CHMI, Keokuk, Iowa

[21] Appl. No.: 09/129,971

[22] Filed: Aug. 6, 1998

[51] Int. Cl.[7] ..... E05D 11/10

[52] U.S. Cl. ..... 16/284; 16/382; 16/331

[58] Field of Search ..... 16/252, 332, 334, 16/382, 331, 322

[56] References Cited

U.S. PATENT DOCUMENTS

| | | | |
|---|---|---|---|
| 3,390,486 | 7/1968 | Walters | 16/331 |
| 4,491,355 | 1/1985 | Marinoni . | |
| 4,689,853 | 9/1987 | Marinoni | 16/382 |
| 5,079,798 | 1/1992 | Burke et al. . | |
| 5,297,313 | 3/1994 | Brin . | |
| 5,513,420 | 5/1996 | Kennedy . | |
| 5,613,276 | 3/1997 | Franz | 16/382 |
| 5,867,869 | 2/1999 | Garrett et al. | 16/382 |

FOREIGN PATENT DOCUMENTS

| | | |
|---|---|---|
| 2642392 | 9/1977 | France . |
| 1965603 | 12/1970 | Germany . |
| 1965604 | 12/1970 | Germany . |
| 376389 | 5/1964 | Switzerland . |
| 404854 | 1/1934 | United Kingdom . |

OTHER PUBLICATIONS

European Patent Application No. 0330973; 16/382, Sep. 1989.

C. R. Lawrence, Lalique Series, Copyright 1994, C.R. Lawrence Co., Inc. 1 pg.

C. R. Lawrence, Petite Series, Copyright 1994, C.R. Lawrence Co., Inc. 1 pg.

C. R. Lawrence, Estate Series, Copyright 1994, C.R. Lawrence Co., Inc. 1 pg.

C. R. Lawrence, Geneva Texas Series, Copyright 1994, C.R. Lawrence Co., Inc. 1 p. 7.

C. R. Lawrence, Prima Series, Copyright 1994, C.R. Lawrence Co., Inc., p. 9.

1994 Derwent Publications, LTD. EPO No. 599,254 A1; Pub. Jun. 1994; INV. K. Loggen; 4 pg. Spec., 1 pg. Drawing.

C. R. Lawrence, Junior Geneva Series, ©1994, C.R. Lawrence Co., Inc., 1 pg.

C. R. Lawrence, Geneva Series, ©1994, C.R. Lawrence Co., Inc., p. 5.

C. R. Lawrence, Zurich Series ©1994, C.R. Lawrence Co., Inc., pg. 3.

C. R. Lawrence, Glass Hinges & Glass Clamps, ©1994, C.R. Lawrence Co., Inc., 1 pg.

C. R. Lawrence, Zurich Elite Series, ©1994, C. R. Lawrence Co., Inc., 1 pg.

*Primary Examiner*—B. Dayoan
*Assistant Examiner*—Mark Williams
*Attorney, Agent, or Firm*—Zarley, McKee, Thomte, Voorhees & Sease

[57] ABSTRACT

An indexing hinge particularly useful for glass shower doors. A mounting member is mountable to the supporting structure around the opening to the shower. For example, this could be at the top and bottom of the opening to the shower. Another mounting member could clamp along the edge of the door. A pivot pin extends between the two mounting members and has one end rotatably journaled in one of the mounting members. A fixing mechanism in the other of the mounting members fixes the pivot pin relative to its respective member. An indexing member includes a detent along the pivot pin and a biased member that is urged against the pivot pin so that when the detent aligns with the biased member, in indexing position and indexing of the door is achieved.

70 Claims, 6 Drawing Sheets

PRESSURE HINGE DEVICE FOR GLASS DOOR OR PANEL

BACKGROUND OF THE INVENTION

1. Field of the Invention

The present invention relates to hinges, and in particular, to hinges that are self-indexing.

2. Problems in the Art

Many different styles and configurations of hinges have been developed over the years. The style and configuration of a hinge can depend substantially upon special needs for the hinge. For example, sometimes there is a need or desire for self-indexing. By self-indexing it is meant that the hinge will hold the pivoting door in a certain position until or unless someone provides sufficient force to move it out of that position. The position discussed is the indexed position.

Therefore, with or without a latch, the door may be kept in a normal or in an indexed position without the door freely pivoting. Then the door can be indexed to one or more positions.

Certain hinges also must support heavy doors. Some must work with doors that are difficult to mount to a hinge. An example of a heavy and difficult to mount door is a glass panel door, an example of which is a ⅜" to ½" glass shower door.

Some hinges also must operate in difficult environments. An example is a shower door which will be in a very humid environment. The hinges will experience substantial humidity and direct contact with water. They also may experience harsh cleaning agents or procedures.

As can be appreciated, certain materials and certain hinge needs therefore require special handling. For example, glass panel shower doors are heavy, difficult to mount, the environment is difficult, and it is many times desirable to have self indexing so that the door cannot freely pivot.

Co-owned pending U.S. Ser. No. 08/319,468, now U.S. Pat. No. 5,867,869, incorporated by reference herein, discloses a hinge that can be advantageously used with glass panel shower doors and provide self or automatic indexing. A main pivot pin includes at least one indexing detent parallel to the pivot axis for the hinge. A subroller pin is held against lateral movement but is biased against the main pivot pin in alignment with a portion of the pin bearing the detent. The main pivot pin rotates with the opening and closing of the shower door. When the main pivot pin and subroller pin are aligned, the subroller pin is forced into at least a part of the detent. This provides the indexing. One only has to apply enough force to the door to cause the subroller pin to move out of the detent to pivot the door and move the door out of its self indexed position.

The above described hinge represented a durable and improved apparatus and method for a self indexing door, especially for glass panel shower doors. The position of the detent is adjustable relative to flattened opposite portions of the main pivot pin that matingly fit into receivers in the other half of the hinge so that different indexed positions are possible. The flattened portions in the receivers thus keep the detent in a stationary position. Rotation of the door would cause the main pivot pin and detent to rotate relative to the fixed sub roller pin. Thus the detent, in operation, was always fixed relative to the door. Different main roller pins could be manufactured with the detents in different positions to provide different self-indexing positions.

Although the above hinge represented in an improvement in the art, it has become recognized that there is still room for improvement. With the above-described hinge, the installer must very accurately mount the portion of the hinge that receives the main pivot pin. If mis-aligned even slightly horizontally relative to the other half of the hinge the indexing may not work properly. Also, the hinge, as disclosed in Ser. No. 08/319,468, now U.S. Pat. No. 5,867,869, is attached only to the side of the door. There are situations where hinges at the top and bottom of the door might be desired.

Real needs in the art have therefore been identified. It is therefore a principal object of the present invention to provide an apparatus and method which improve upon the state of the art. Other objects, features, and advantages of the invention include:

1. Positive yet adjustable self-indexing of a pivoting door.
2. Durability in many environments including high humidity and direct contact with water.
3. Adaptability to many different uses.
4. Reduction in the need for highly precise mounting of the hinge halves.
5. Adaptability to top and bottom hinges or side hinges.
6. Multiple indexing positions.
7. Strength to support relatively heavy doors.

These and other objects, features, and advantages of the present invention will become more apparent with reference to the accompanying specification and claims.

SUMMARY OF THE INVENTION

The present invention is an apparatus and method related to an indexing hinge. A mounting base is securable to a supporting structure. The supporting structure can be above or below the door but is not necessarily so limited. A mounting member is securable to the item to be pivoted. A pivot pin having a pivot axis is secured relative to one of the mounting base or the mounting member. The pivot pin has an indexing detent along its longitudinal length. A biased member is generally fixed in the other of the mounting member and mounting base but biased against the perimeter of the pivot pin. The biased member has biased supports relative to the pivot pin so that upon alignment of the detent with the biased member, the biased member at least partially enters the detent to provide an indexed catch or stop. Release from the indexed catch or stop is possible upon the application of sufficient forces to rotate the pivot pin so that the detent moves away from the biased member.

The method according to the invention includes securing the first member to the perimeter of an item to be pivoted. A second member is secured to a supporting structure. An indexing detent is formed along the longitudinal axis of a pivot pin positioned between the first and second member. A biased member is biased against the pivot pin and at least partially enters the indexing detent when aligned with the biased member, thereby aligning the indexing detent when pivoting the item to be pivoted to an indexed position.

In one embodiment of the invention, the mounting member is clamped or secured to a glass panel shower door and the mounting base is secured to the framework surrounding the opening to the shower. The hinge can work by clamping to the top and bottom of the shower door with the mounting g members being secured to the floor or stoop of the shower opening and soffits, header or sidelight above the shower door.

BRIEF DESCRIPTION OF THE DRAWINGS

FIG. 3 illustrates the indexing hinge attached to the upper left side of a glass panel shower door and ghost lines indicate pivoting of the shower door in two directions.

FIG. 6 shows attachment of the indexing hinge to a glass panel shower door and the indexing mechanism of the hinge. FIG. 6 shows the door in the indexed position.

DETAILED DESCRIPTION OF THE PREFERRED EMBODIMENT

Figure 1:
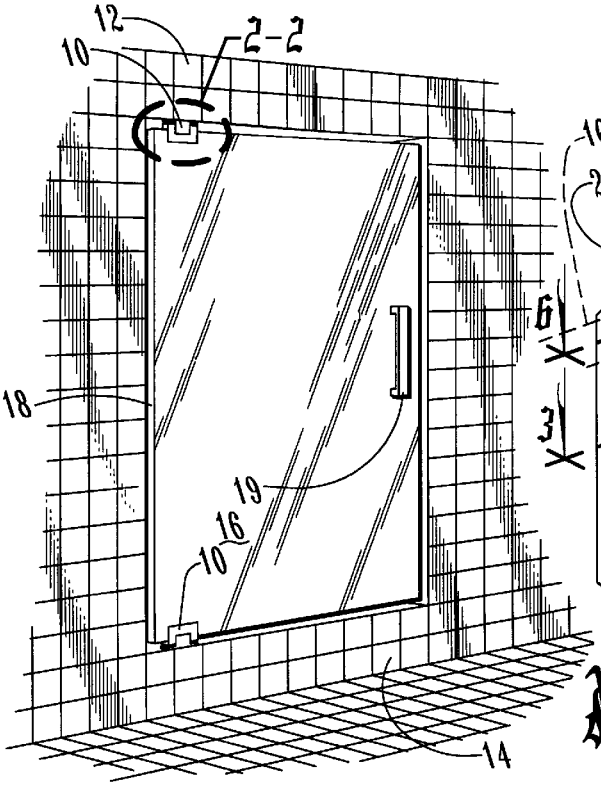
FIG. 1 is a perspective view of a glass panel shower door pivotally secure at the left top and bottom to supporting structure above and below the opening to the shower.

To obtain a better understanding of the invention, detailed description of one preferred embodiment the invention can take will now be set forth. Frequent reference in this description will be taken to the drawings. Reference numerals will be used to indicate certain parts and locations in the drawings. The same reference numerals will be used to indicate the same parts and locations throughout the drawings unless otherwise indicated.

The preferred embodiment is discussed relative to a glass shower door, such as is well-known, pivotally secured in the opening to a shower. No mechanical latch or lock or sill need to be used with the door although such is not precluded. The indexing hinges according to the present invention are placed at the top and bottom of the door and therefore have to be secured to supporting structure above and below the door. It is to be understood, however, that the indexing hinge according to the present invention is not necessarily limited in those ways.

FIG. 1 shows top and bottom hinges 10 mounted respectively to the soffit or overhead defining the top of the opening into a shower (reference number 12) and the stoop or bottom defining the bottom of the opening into the shower (reference number 14). Each hinge is secured to the top and bottom of shower door 16 but near to the left side 18 of door 16, is viewed in FIG. 1. Door 16 pivots about a pivot axis that extends through hinges 10. A handle 19 on the opposite side of door 16 can optionally be used to open and close door 16.

Therefore, as shown in FIG. 1, the vertical pivot axis through hinges 10 allows door 16 to be pivoted around that vertical pivot axis between a closed position (as shown in FIG. 1), and open positions. The opening to the shower may or may not have a sill, jamb or stop to limit the pivotal movement of door 16. Therefore, without such a blocking structure, door 16 could pivot or open both outwardly and inwardly with the only limit being the structure adjacent edge 18 of door 16, if door 16 is rotated almost 360° in either direction.

Figure 2:
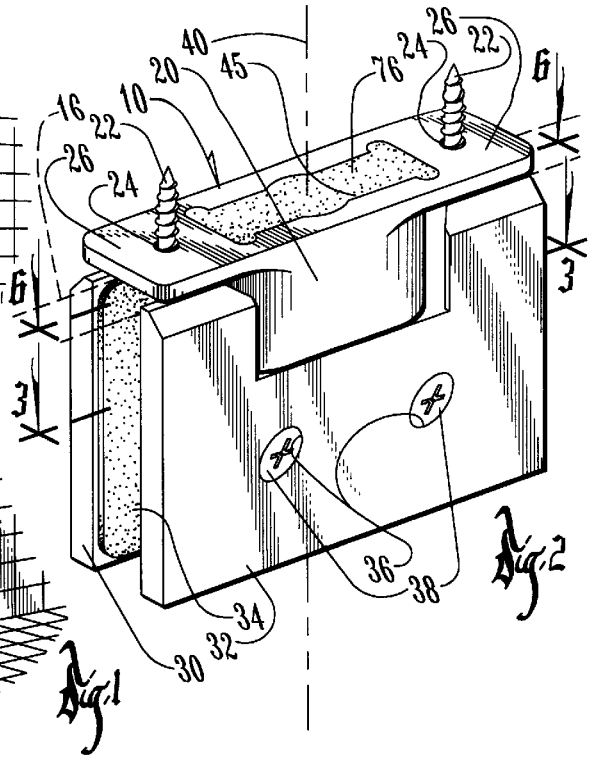
FIG. 2 is an enlarged isolated perspective view of an indexing hinge according to a preferred embodiment of the invention.

FIG. 2 illustrates, in enlarged fashion, a hinge 10. Because both top and bottom hinges 10 are identical in structure, only one will be discussed herein. The opposite hinge 10 simply needs to be reversed in orientation as is shown in FIG. 1.

Hinge 10 comprises what will be called tram body 20 as a mounting member to the supporting structure defining the opening to the shower. Screws 22 can be placed through apertures 24 in flanges 26 of tram body 20 to mount tram body 20 to a soffit, stoop, or other structure defining the opening to the shower. Such structure can include overheads, sidelights, floors, walls, or any supporting structure. Other mounting hardware could be used such as is well within the skill of those skilled in the art. The glass shower door is gripped by a clamp comprising what is called pivot body 30 and a cover plate 32. As will be discussed in more detail later, each of members 30 and 32 has a recess which includes a gasket 34 to grip the sides of the glass shower door. Cover plate 32 has apertures 36 into which screws 38 pass and mate into threaded apertures in pivot body 30. Cover plate 32 and pivot body 30 can then be brought together to provide a clamping action on opposite exterior sides of door 16. Reference can be taken to application Ser. No. 08/319,468 regarding the details of this clamping action. In a preferred embodiment, particular cutouts 28 in the margin of door 16 (see FIG. 12) at the location of pivot body 30 are made to assist in secure mounting of hinge 10 to glass door 16.

As will be further discussed below, a pivot pin has one end which is fixed in pivot body 30. The opposite end of the pivot pin (not shown in FIG. 2, but see FIGS. 3–5) extends into tram body 20 where it is rotatably journaled. A pivot axis indicated generally at 40 in FIG. 2 is then defined. The configuration of the pivot pin and tram body 20 is such that upon rotation of pivot body 30 (and cover plate 32), the pivot pin rotates in tram body 20 but pivot body cover plate 30/32 cannot be separated from tram body 20.

Figure 3:
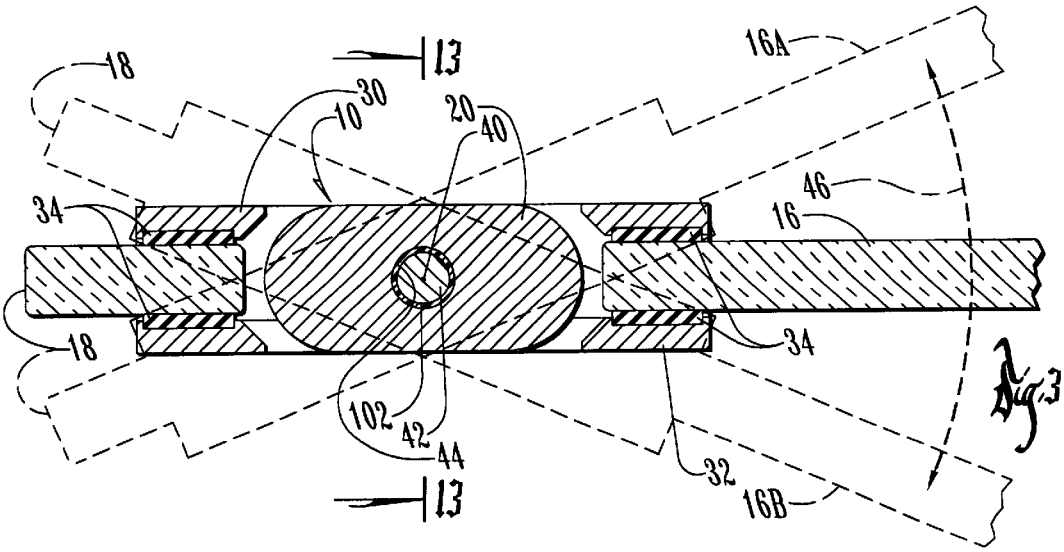
FIG. 3 is a still further enlarged sectional view taken along line 3—3 of FIG. 2 and including the sectional view of a glass panel shower door to which the indexing hinge is mounted.
Figure 4:
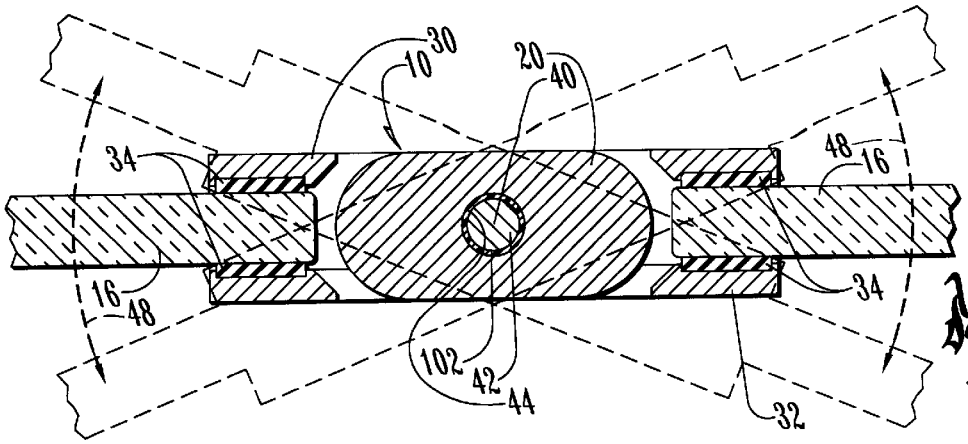
FIG. 4 is similar to FIG. 3 except it illustrates the indexing hinge according to the preferred embodiment of the present invention secured to the center of the glass panel shower door. Ghost lines show pivoting in opposite directions of the shower door.

FIGS. 3 and 4 show generally how hinge 10 allows pivoting movement of door 16. It can be seen in FIG. 3, tram body 20 is fixed from movement by its attachment to the soffit or overhang. It includes an aperture 44 in which a main pivot pin 42 is rotatably journaled. Pivot body 30 and cover plate 32, with gaskets 34, clamp door 16 at opposite sides of tram body 20. Pivot pin 42 extends downwardly (FIG. 3 is a top sectional view looking downward) to pivot body 30 where it is fixedly secured. Therefore, as is shown in dashed lines at 16A and 16B in FIG. 3, door 16 can move away from the position in solid lines in either direction (see arrow 46).

Note that in FIG. 3, hinge 10 is attached to door 16 in the position shown in FIG. 1, near side 18 of door 16. Thus, door 16 pivots about its one side defined by side 18.

Figure 12:
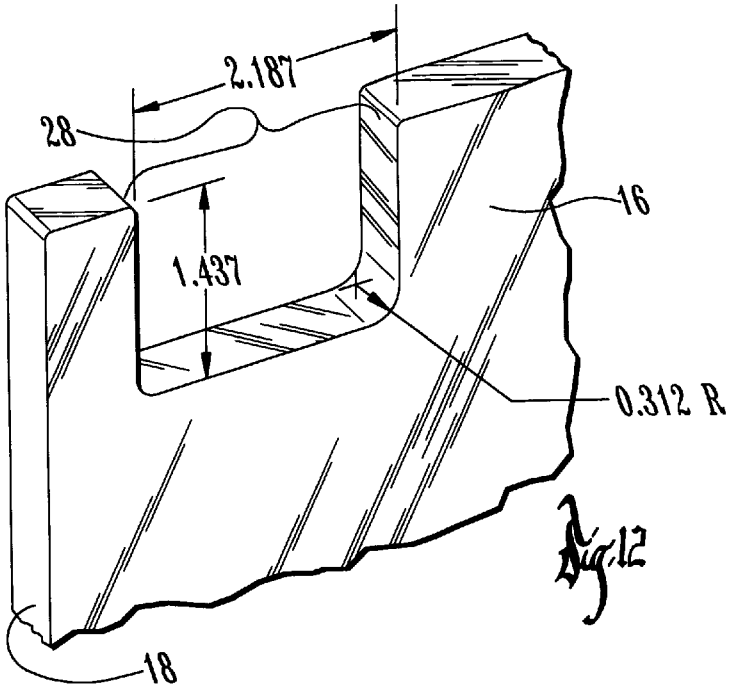
FIG. 12 is an isolated, partial perspective view of a glass panel shower door and cut out to receive the indexing hinge of FIG. 1.

In comparison, FIG. 4 shows how hinge 10 could be placed at or near the center top and bottom of door 16, (with appropriate cutouts 28 as indicated at FIG. 12). Tram body 20 would be fixed to the soffit or overhang at or near the center of the opening to the shower and likewise the second tram body 20 secured to the center of the stoop or bottom of the opening to the shower. Pivot body 30 and cover plate 32 would clamp door 16 at or near its top and bottom center and pivot pin 42 would be appropriately assembled. In this case the pivot axis for the door would essentially be down its center. As shown by arrows 48 in FIG. 4, door 16 can potentially pivot in either direction but such pivoting would be down a vertical and central pivot axis. This is sometimes desired. Door 16, if no mechanical stops existed around its perimeter, could rotate 360° or more in either direction.

Figure 5A:
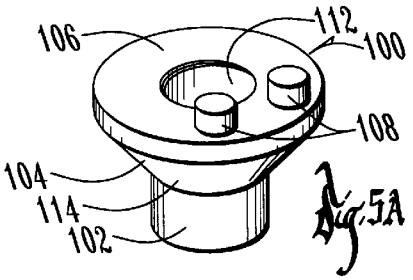
FIG. 5A is an enlarged isolated view of a bearing support used in the hinge of FIG. 5.
Figure 5:
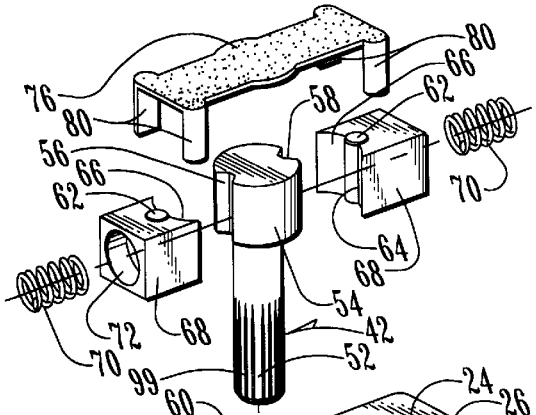
FIG. 5 is an exploded perspective view of the indexing hinge of FIG. 2.
Figure 5:
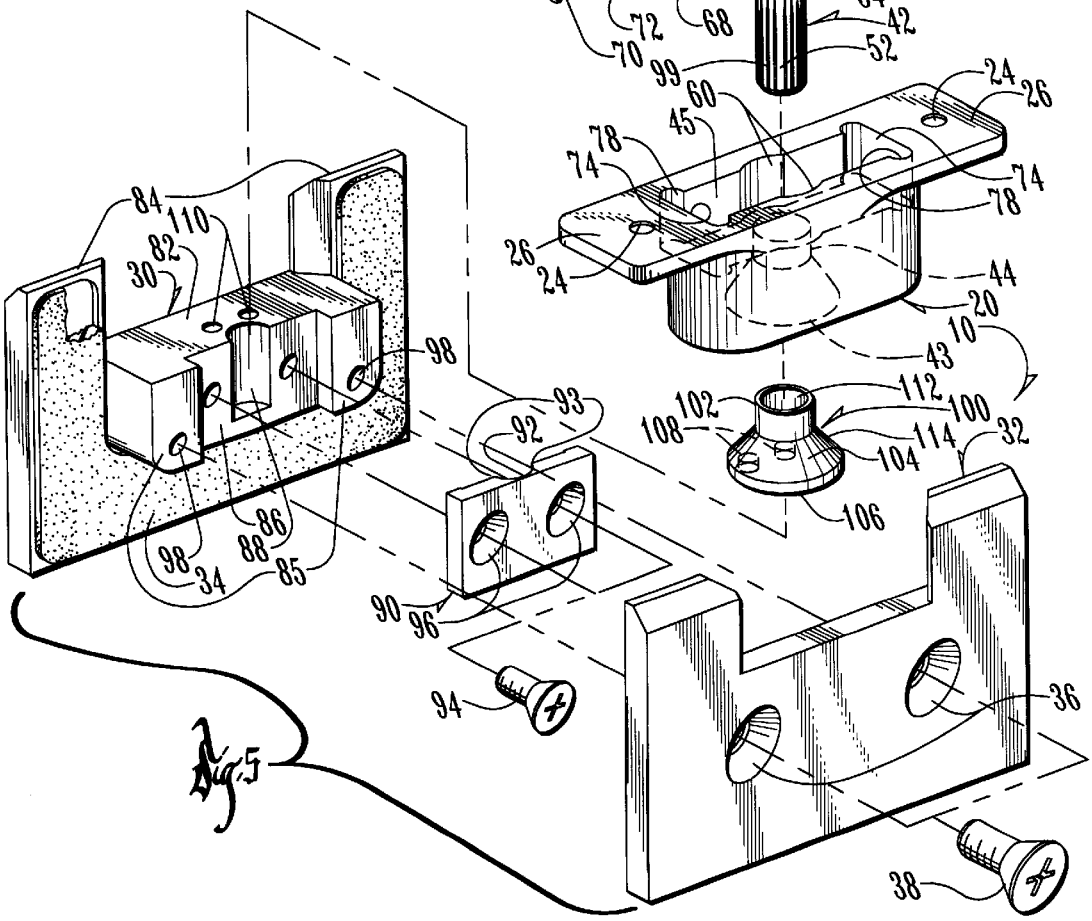

FIG. 5 illustrates all the parts of hinge 10 in exploded fashion. Tram body 20 includes pivot pin aperture 44 which extends from an opening end 43 into an enlarged hollow 45. The ghost lines of FIG. 5 illustrate portions 43, 44, and 45. Main pivot pin 42 has a first end 52 that is slightly smaller in diameter than the inside diameter of pivot pin aperture 44. A second end 54 of main pivot pin 42 has a larger diameter than first end 52. End 54 also contains longitudinal detents 56 and 58.

The diameter of opposing concave walls 60 on opposite sides of hollow 45 are slightly bigger in diameter than the diameter of end 54 of main pivot pin 42 and receive end 54. Because end 54 is larger in diameter than pivot pin aperture 44, main pivot pin 42, when assembled, results in its end 52 being rotatably journaled in pivot pin aperture 44 but with the outermost portion of end 52 extending through and outside of portion 43. End 54 of main pivot pin 42 is rotatably journaled in opposing concave walls 60 but cannot move into pivot pin aperture 44 because aperture 44 is smaller than end 54 of pivot pin 42.

Biasing members are installed in tram body 20 on opposite sides of end 54 of main pivot pin 42, when installed, to provide indexing for hinge 10. As shown in FIG. 5, each biasing member comprises a sub roller pin 62 of metal, force fit into a complimentary groove 64 in the concave face 66 of spring guide 68. A spring 70 has one end which enters cutouts 72 in the portion of spring guide 68 opposite concave face 66.

As shown in FIG. 5, there is a biasing member combination (spring guide 68, sub roller pin 62, and spring 70) on each side of end 54 of main pivot pin 42. The combination of both biasing members and main pivot pin 42 are placed into hollow 45 by compressing springs 70 while spring guides 68 are against end 54 of main pivot pin 42. As can be seen in FIG. 5, hollow 45 includes opposite end walls 74 which serve as fixed walls of abutment with opposite springs 70.

Figure 13:
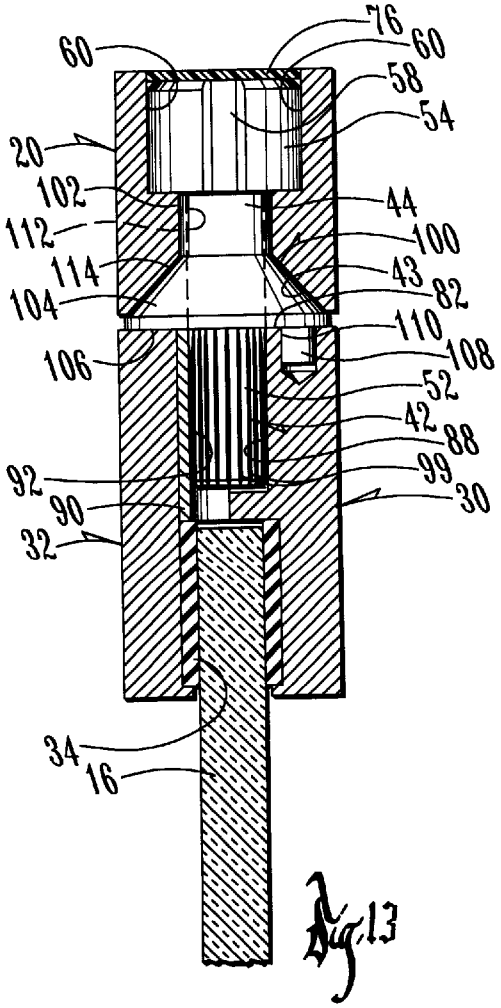
FIG. 13 is a sectional view taken along line 13—13 of FIG. 3.

Once the biasing members and main pivot pin 42 are assembled into hollow 45 and pivot pin aperture 44, base cover 76 is inserted over large hollow 45. As can be seen in FIG. 5, enlarged portions 78 on opposite sides of end walls 74 of hollow 45 receive legs 80 of base cover 76 to assist in positioning and holding base cover 76 in position. Note also that the perimeter of base cover 76 follows the outline of hollow 45. Once assembled, tram body 20 and main pivot pin 42 are such that end 54 of main pivot pin 42 is rotatably journaled between opposing concave walls 60. Sub roller pins 62 are biased against the perimeter of end 54 of main pivot pin 42 by springs 70 and spring guides 68. As previously mentioned, main pivot pin 42 cannot move further towards pivot pin aperture 44 because of its size. Once tram body 20 is installed against the supporting surface by screws 22 (see FIG. 2), main pivot pin 42 cannot move out of tram body 20 in any direction. It can rotate about axis 40 (see FIG. 2). See FIG. 13, a cross-sectional view of assembled hinge 10 to more clearly see the relationship of parts of hinge 10.

Also, once tram body 20 and pin 42 are assembled, end 52 of main pivot pin 42 extends substantially outside of tram body 20. As will be discussed below, this free end 52 of pin 42 will be received and fixed in pivot body 30. FIG. 5 also shows pivot body 30 has a main portion 82 and a clamping portion 84. Main portion 82 includes a top surface 85, a depression 86, and a concave cutout 88. A clamp block 90 has perimeter dimensions to fit within depression 86 and be secured in position by bolts 94 through apertures 96. Clamp block 90 also includes a concave cutout 92 which lines up with concave cutout 88 of main portion 82.

Cover plate 32 also includes a gasket (not shown in FIG. 5) like gasket 34 of pivot body 30. Top surface 84 of main portion 82 of pivot body 30 includes threaded apertures 98 to receive screws 38 to clamp cover plate 32 to pivot body 30.

Final assembly of the total hinge 10 includes positioning the outermost portion of end 52 of main pivot pin 42 (extending out of tram body 20) into cutout 88 of pivot body 30 and then securing clamp block 90 over end 54 of main pivot pin 42. End 54 includes knurls or longitudinal cuts 99. Concave cutout 92 of clamp block 90 is of a smaller circular diameter than the diameter of end 54 of main pivot pin 42. Thus, the edges 93 on both sides of concave cutout 92 corporate with longitudinal cuts 99 to secure end 54 of main pivot pin 42 in pivot body 30 and hold it against rotation while clamped by clamp block 90.

A support bearing 100 has a first end 102 that is received and mates into pivot pin aperture 44 in tram body 20. The second end 104 of bearing 100 is cone shaped and larger in diameter than first end 102 and matingly fits into the cone shaped void 43 in tram body 20. The outer end surface 106 of bearing 100, being flat, includes two pins 108 which mate into holes 110 in portion 82 of pivot body 30 (see FIG. 13).

Thus, end 52 of main pivot pin 42 passes closely through the hollow channel 112 in support bearing 100 and is clamped by clamp block 90 into concave cutout 88 pivot body 30. Support bearing 100 is fixed from rotation by pins 108 in holes 110, and abuts but separates pivot body 30 from tram body 20 and provides a bearing surface 114 between the adjacent surface of tram body 20 (in void 43) (see FIG. 13). Tram body 20 will be fixed to a wall. Bearing 100 is fixed to pivot body 39. Thus pivoting of pivot body 30 will cause pivot bearing 100 to rotate in void 43 of tram body 20.

Figure 6:
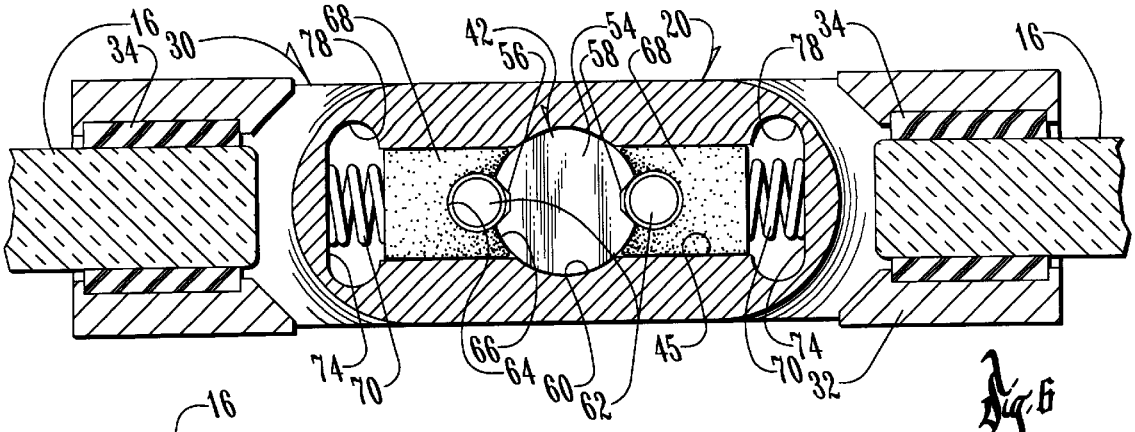
FIG. 6 is an enlarged sectional view taken along lines 6—6 of FIG. 2.
Figure 7:
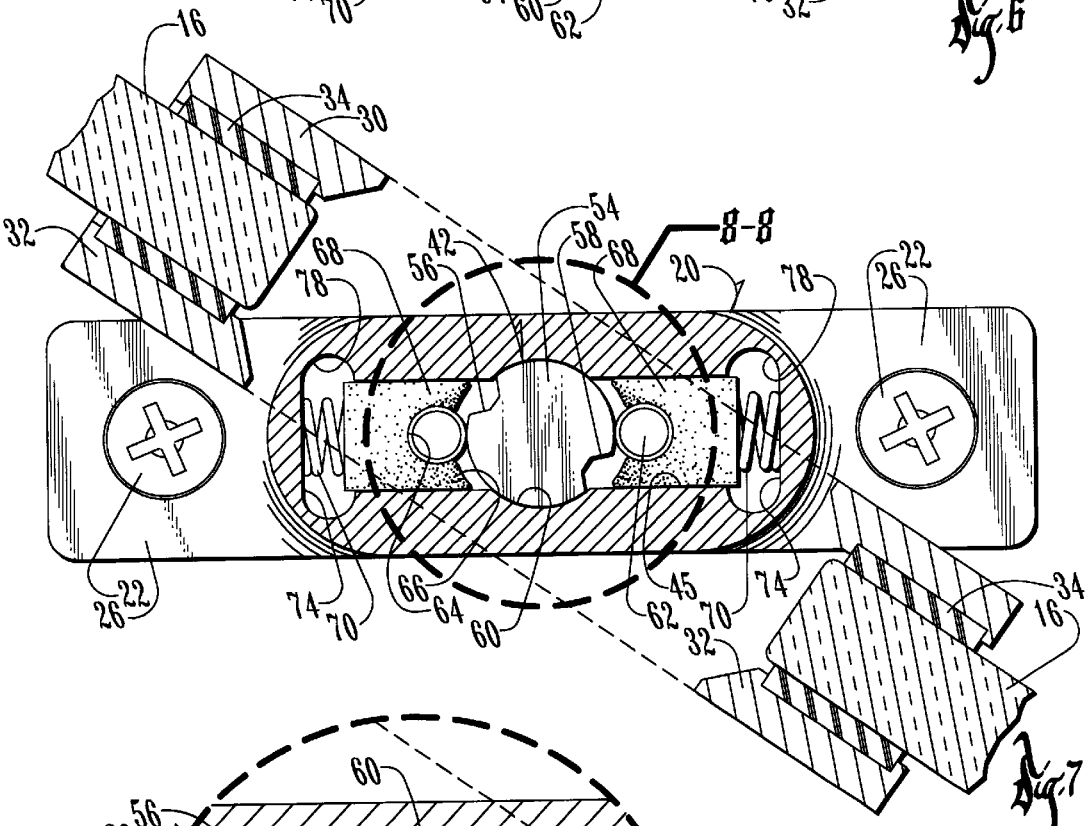
FIG. 7 is similar to FIG. 6 except it shows the glass door and the portion of the indexing hinge secured to the glass door rotated out of the indexed position.
Figure 8:
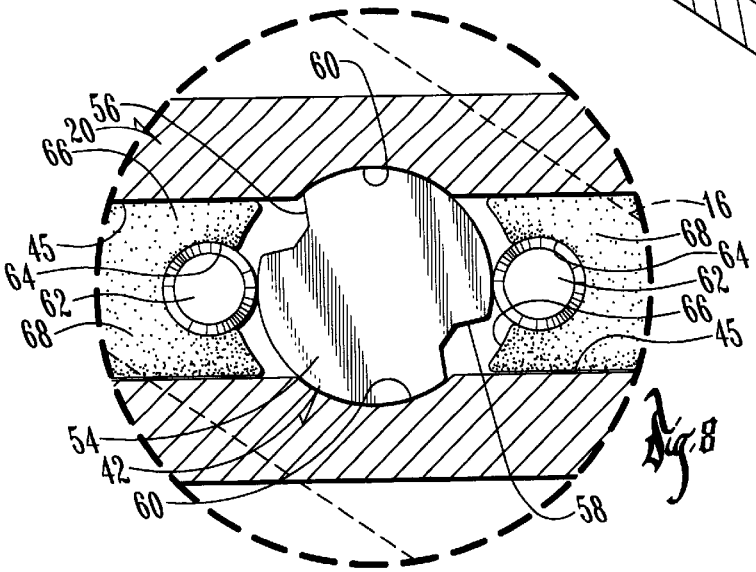
FIG. 8 is an enlarged view of the portion indicated by line 8—8 in FIG. 7.

FIGS. 6–8 illustrate the operation of hinge 10. FIG. 6 shows, in sectional view, the assembled indexing hinge 10. FIG. 6 is a view looking down on top of end 54 of main pivot pin 42. Pivot pin 42 has a rotational position such that detents 56 and 58 align with sub roller pins 62. As can be seen, each spring 70 push against a wall 74 and thus bias spring guides 68 towards pivot pin 42. This in turn biases sub roller pins 62 against the perimeter of end 54 of main pivot pin 42.

Note that the diameter of sub roller pins 62 is larger than the distance across detents 56 and 58, but is small enough so that a portion of sub roller pin 62 enter detents 56 and 58. By this manner, when door 16 is in the position shown in FIG. 6, it is indexed. By indexing it is meant that the entry of sub roller pins 62 into detents 56 and 58 tends to hold door 16 against rotation.

FIG. 7 shows door 16 rotated from the position of FIG. 6. Because end 54 of pivot pin 42 is clamped to pivot body 30. Pivot pin 42 rotates with the pivoting of door 16. Therefore, if sufficient force is applied to door 16 to overcome the forces of sub roller pins 62 biased into detents 56 and 58, end 54 of main pivot pin 42 will rotate out of alignment with sub roller pins 62. Springs 70 will continue to bias sub roller pins 62 against the perimeter of end 54 of main pivot pin 42, but since sub roller pins 62 are not in detents, there is no indexing or tendency to hold door 16 from rotation. Sub roller pins 62 would follow the smooth convex portions of end 54 of pivot pin 42 between detents 56 and 58, and not impede rotation of door 16.

FIG. 8 shows in enlarged detail the relationship of detents 56 and 58 to sub roller pins 62 when door 16 is rotated from the indexed position.

The included preferred embodiment is given by way of example only, not by way of limitation to the invention, which is solely described by the claims herein. Variations obvious to one skilled in the art will be included within the invention defined by the claims.

Figure 9:
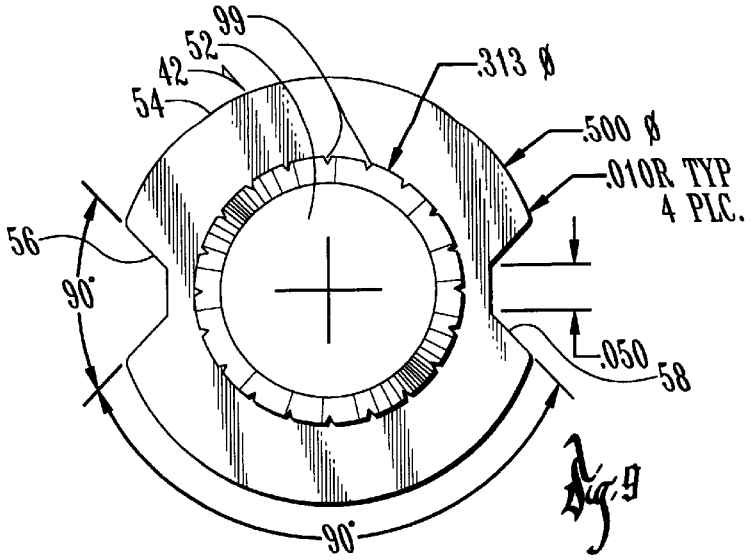
FIG. 9 is an enlarged bottom end view of the main pivot pin and indexing detents of the main pivot pin shown in perspective in FIG. 5 and cross section in FIGS. 6–8.

It will be appreciated that the relative dimensions and materials of parts of hinge 10 can vary according to desire and need. FIG. 9 illustrates certain dimensional characteristics of main pivot pin 42 according to the preferred embodiment described herein. Main pivot pin 42 is 1.456 inches in total length, with first end 52 being 1.081 inches in length. The knurling or longitudinal cuts can be 0.75 inches long from the end inwardly.

The radial depth of detents 56 and 58 can be approximately 0.615 inches. The material of pivot pin 42 can be 303 stainless steel. Sub roller pins can be 0.094 inches in diameter and also made of stainless steel. Spring guide 68 can be nylon 0.445 inches long and 0.370 inches wide. Springs 70 are compression type springs and have a length of 0.447 inch, a diameter of 0.300 inch, a gauge size of 0.063 inch, spring constant of 542.37 #/in. and are stainless steel 17-7 passivated. Tram body 20 is made of brass 3600. It is 3.375 inches end to end. It is 0.872 inches from bottom to top. It is 1.650 inches from end wall 74 to end wall 74. The radius of concave faces 60 is 0.510 inch.

Pivot pin aperture 44 is 0.406 inch in diameter. Countersunk void 43 widens at a 45 degree angle from 0.406 inch to 0.75 inch diameter to receive end 102 of bearing 100 and bearing surface 114 of the second end 104 of support bearing 100. Bore 112 through bearing 100 is 0.320 inches in diameter.

Support bearing 100 is made of nylon 6-6 and has a 0.396 inch outside diameter. Surface 114 is 135 degrees from the sidewall of end 102 of bearing 100. The distance between opposite end surfaces of bearing 100 is 0.456 inches, the length of first end 102 is 0.231 inches. The distance from the end of first end 102 to the end of bearing surface 114 is 0.366 inches. The height of pins 108 is 0.125 inches and their diameter is 0.125 inches. They are spaced apart linearly 0.375 inches.

Pivot body 30 is made of brass 3600. Flanges 26 are 0.2 inches thick with the recesses for gaskets being 0.055 inches (also see FIG. 5).

The longest dimension of portion 82 is 2.0 inches and its width is 0.75 inches. Depression 86 is 0.144 inch deep and concave cutout 88 has a radius of 0.156 inch compared to the 0.141 inch radius of concave cutout 92 of clamp block 90.

Cover plate 32 is made of brass 3600, has a thickness of 0.200 inch with recess depth of 0.055 inches for the gasket 34 which is 3/32" thick.

Cutouts 28 in door 16 to receive portion 82 of pivot body 30 are 2 3/16 inches long and 1 7/16 inches in depth from the edge of door 16. Corners are cut at a radius of 5/16 inch to correspond to the rounded corners on pivot body 30.

Clamp block 90 is made of brass 377 and has outside dimensions of 0.990 inch long and 0.750 wide. It is 0.200 inch thick with the 0.155 inch radius for concave cutout 92. It can also have a slight depression of approximately 0.015 inches on either side and including concave cutout 92.

Gasket 34 are neoprene 3/32 inches 85 Duro Neoprene in a C-shape. They are 3.255 inches long and 1.880 inches wide. Each leg of the C-shape is 0.568 inches wide. The interior of the C-shape is 1.315 inches by 2.120 inches with a radius of 0.25 inches curved interior corners. The exterior curved corners are 0.125 inch radius.

Base cover 76 is nylon 6-6 having a total overall length of 1.640 inches and a thickness of 0.058 inches. The height of legs 80 is 0.433 inches.

Figure 11:
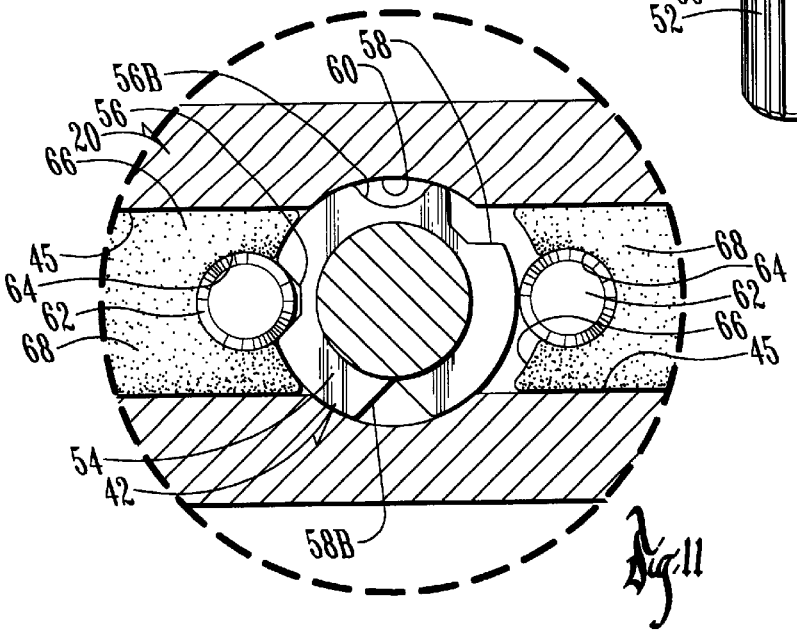
FIG. 11 is similar to FIG. 8 which showing the main pivot pin in FIG. 10 in place in the indexing hinge according to the present invention.

FIG. 9 illustrates the use of two detents 56 and 58 for main pivot pin 42. Thus, in the indexed position, two sub roller pins 62 and two detents 56 and 58 simultaneously work to hold the door in the indexed position. However, it is to be understood that one detent and one sub roller pin could be used. Alternatively more than two sub roller pins 62 and detents could be used. The precise shape of the detents can vary (see e.g. 56B and 58B FIG. 11). As shown in FIGS. 6 and 11, sub roller pin 62, when in a detent, abuts at two points on opposite sides of the detent.

Figure 10:
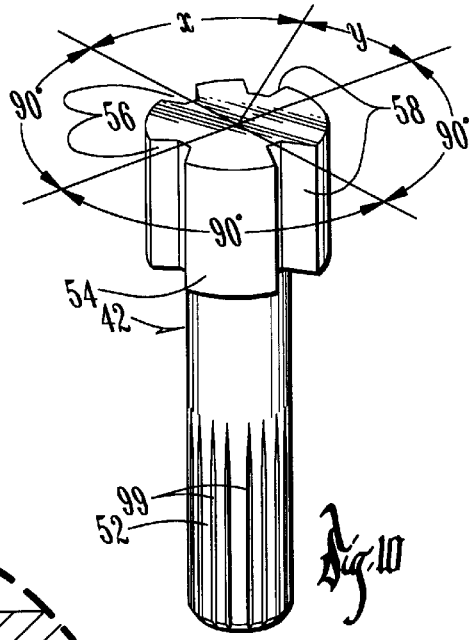
FIG. 10 is an enlarged perspective view of an alternative embodiment of a main pivot pin.

FIGS. 10 and 11 illustrate that the detents do not have to be at 90 degrees to one another. If multiple indexing positions are desired, one or more detents can be placed at other than 90 degrees to one another. If, for example, an indexed position at 45 degrees was desired, the detent would simply have to be formed at the appropriate position. Any angle is possible. This further highlights that if an indexing position different from an original indexing position is desired, pin 42 would merely have to be changed rather than the entire hinge.

It is to also to be understood that an advantage of hinge 10 is that it is adjustable after tram body 20 has been installed. As previously mentioned, if, for example, mounting holes for tram body 20 are drilled into a supporting wall but are not perfectly aligned with the plane of the opening to the shower, tram body 20 can still be installed into those drilled holes and the proper indexing can work. Therefore, even though the relationship between the detents in pin 42 and the sub roller pins 62 is fixed when tram body 20 and pivot pin 42 are assembled, end 52 of main pivot pin 42 can be placed into concave cutout 88 in pivot body 30, the door adjusted to the desired indexed position, and then clamp block 90 secured to pivot body 32 to fix the orientation of door 16 to hinge 10. Thus, by aligning the detents 56 and 58 with sub roller pin 62 when mounting tram body 20, the installer can compensate for any misalignment in installation of tram body 20 by this method.

It is furthermore emphasized that as shown in the drawings, indexing hinge 10 can be used either at the top and bottom and towards the either side of door 16, or towards the middle of the top and bottom of door 16. In fact, any locations along the top and bottom of door 16 are possible. By appropriate modifications, hinges 10 can also be used along either vertical side of door 16.

Figure 16:
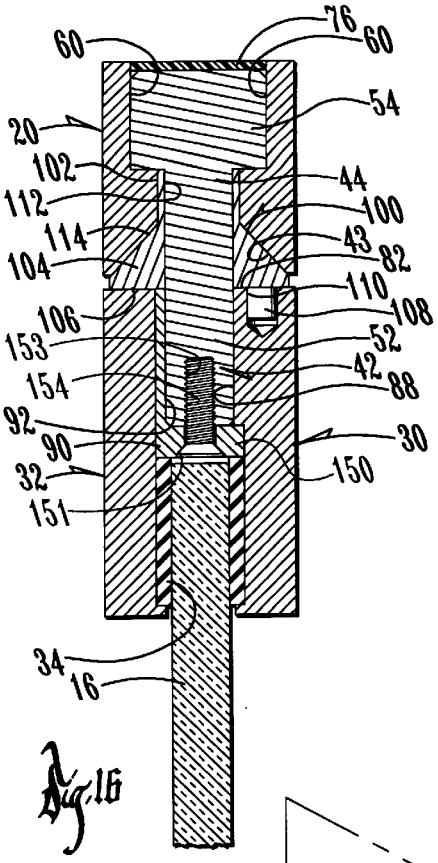
FIG. 16 is an enlarged sectional view similar to FIG. 13 but showing the embodiment of FIGS. 14 and 15.
Figure 15:
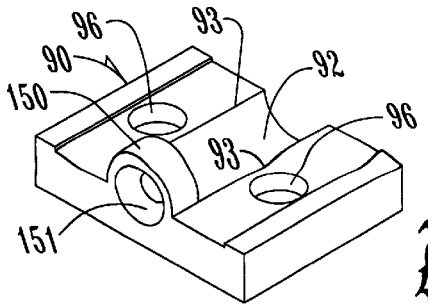
FIG. 15 is an enlarged perspective view of part 90 of FIG. 14.
Figure 14:
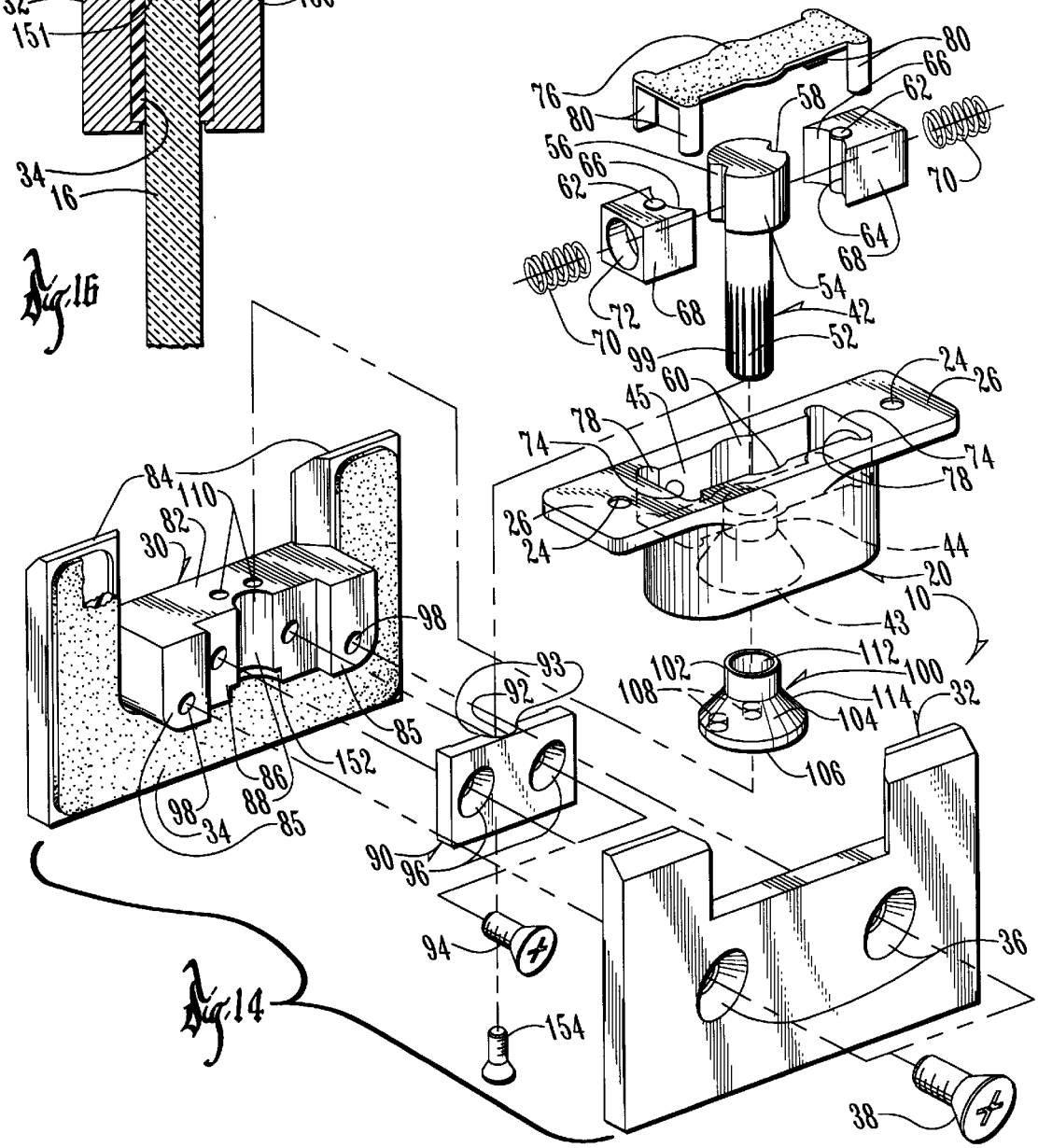
FIG. 14 is an alternative embodiment of FIG. 5.

An alternative concept is shown at FIGS. 14–16. It may be advantageous in certain circumstances to fix pivot pin 42 in place in the hinge. One such circumstance is when the hinge is installed upside down. To reduce end play, clamp block 90 could include a protrusion 150 (FIG. 14) that includes an aperture 151 therethrough. A mating hollow 152 (FIG. 14) could be formed in pivot body 30 to receive protrusion 150 when clamp block 90 is assembled thereto.

Pivot pin 42 can have an axial threaded bore 153 (FIG. 16). A machine screw 154 could pass through aperture 150 in clamp block 90 and into bore 153 to fix pivot pin 42 in place to reduce or eliminate end play.

What is claimed is:

1. A hinge for a panel door comprising:

a mounting base to facilitate mounting of the base to a supporting structure above or below a door;

a mounting member including portions to facilitate mounting of the mounting member to a peripheral top or bottom edge of a door;

a pivot pin extending between and having portions in the mounting base and the mounting member respectively and defining a pivot axis;

a fixing mechanism in one of the mounting plate and the mounting member, the fixing mechanism fixing the pivot pin in a selected rotational position in and disallowing rotational movement relative the said one of the mounting base and the mounting member;

an indexing mechanism in the other of the mounting base and the mounting member, the indexing mechanism including detent along the side of the pivot pin and a biased member having an end biased against the pivot pin, the biased member deterring rotation of the pin and the one of the mounting base and the mounting member relative to the other to allow indexing of a door by biasing the biased member at least partially into the detent when the biased member is in alignment with the detent, rotation of the pin and the one of the mounting base and mounting member relative to the other being allowed when sufficient forces are provided to overcome the biasing and move the detent of the pin out of alignment with the biased member.

2. The hinge of claim 1 wherein the panel door is a glass plate door.

3. The hinge of claim 2 wherein the glass plate door includes cutouts along its periphery.

4. The hinge of claim 1 wherein the mounting base includes mounting hardware to mount the mounting plate to a supporting structure.

5. The hinge of claim 4 wherein the supporting structure is selected from the set comprising a ceiling, floor, soffit, sidelight, header, and shower frame.

6. The hinge of claim 1 wherein the mounting member further comprises first and second portions, one removable relative to the other, each portion having a clamping surface, and further comprising means to adjust said first and second portions to apply clamping forces.

7. The hinge of claim 6 further comprising gaskets placable on or in the mounting member to provide a seal between the clamping surfaces and a door.

8. The hinge of claim 7 further comprising pockets formed in the clamping surfaces, each pocket configured to matingly receive a gasket, but when the gaskets are seated in the pockets, said gaskets extend above the clamping surfaces.

9. The hinge of claim 8 wherein the gaskets are made of neoprene.

10. The hinge of claim 1 wherein the portion of the pivot pin aligned with the fixing mechanism is knurled, and the portion of the pivot pin containing the detent is larger in diameter than the knurled portion.

11. The hinge of claim 1 wherein the fixing mechanism comprises a clamping block and an adjustable mounting hardware, a portion of the pivot pin being placed between the clamping block and, the adjustable mounting hardware, the adjustable mounting hardware being adjustable to provide clamping pressure sufficient to prevent rotation of the pivot pin relative to said clamping block.

12. The hinge of claim 1 wherein the detent comprises a groove.

13. The hinge of claim 12 wherein the groove is generally V-shaped.

14. The hinge of claim 13 wherein the groove has a flat central longitudinal portion and outwardly diverging opposite walls.

15. The hinge of claim 14 wherein the walls are at approximately 90 degrees to one another.

16. The hinge of claim 1 wherein the pin includes a plurality of detents.

17. The hinge of claim 16 wherein two detents are spaced 180 degrees apart from one another around the pivot pin.

18. The hinge of claim 1 wherein the biased member comprises a surface which at least partially fits within a detent.

19. The hinge of claim 18 wherein the surface comprises a convex surface.

20. The hinge of claim 19 wherein the surface is the outer surface of a roller pin.

21. The hinge of claim 20 wherein the biased member is a roller pin, the detent is a V-shaped groove, the diameter of the roller pin is greater than the largest width of the V-shaped groove.

22. The hinge of claim 21 further comprising a mounting block holding the roller pin but exposing a part of the outer curved surface of the roller pin, and further comprising a spring positioned between the mounting block and the other of the mounting base and mounting member.

23. The hinge of claim 22 further comprising first and second biased members positioned in the other of the mounting base and mounting member and first and second detents in the pivot pin.

24. The hinge of claim 1 further comprising a bearing member positioned between the mounting base and the mounting member.

25. The hinge of claim 1 further comprising in combination with said hinge, a panel door.

26. A shower door hinge for mounting a panel shower door and providing indexing for the door comprising:

a base attachable above or below a door including means for securement to a supporting structure above or below a door;

a clamping mechanism having first and second surfaces and an adjustable connection operable to move the first and second surfaces together adapted to provide clamping action on a perimeter portion of the door;

a main shaft having a longitudinal axis and first and second ends, the second end including at least one indexing detent aligned along the longitudinal axis;

a tram body on the base, the tram body comprising a block, an opening in the block, a sub-roller pin, and a bias member, the second end of the main shaft being rotatably positioned in the opening in the block, the first end of the main shaft extending out of the opening in the block, the sub-roller pin in parallel with the longitudinal axis of the main shaft and biased into abutment with the second end of the main shaft;

a pivot body on the clamping mechanism, the pivot body comprising a complementary receiver for the first end of the main shaft and a securement mechanism which fixes the first end of the main shaft in the pivot body in an adjustable selected rotational orientation relative to the pivot body;

so that when the sub-roller pin is aligned with the indexing detent, the biased member causes automatic indexing of the hinge and requires force sufficient to move the sub-roller pin out of the detent to rotate the tram body relative to the pivot body, and so that any rotational orientation of the pivot body relative the tram body when the sub-roller pin is in the detent can be adjustably selected.

27. The hinge of claim 26 wherein the panel shower door is glass plate.

28. The hinge of claim 26 wherein the base is adapted for attachment at the top or bottom of a door but near a side of a door.

29. The hinge of claim 26 wherein the base is adapted for attachment at a top or bottom of a door but at or near the middle of a door.

30. The hinge of claim 26 wherein the base includes a plate having apertures for receiving securing members adapted for connection of the hinge to supporting structure.

31. The hinge of claim 26 wherein the clamping mechanism comprises two separate pieces joinable together to create clamping action.

32. The hinge of claim 26 wherein the detent comprises a V-shaped groove.

33. The hinge of claim 32 further comprising first and second detents spaced apart from one another around the exterior of the main shaft.

34. The hinge of claim 26 wherein the tram body is integral with the base.

35. The hinge of claim 26 wherein the tram body includes a cavity in which the subroller pin is movable laterally towards the main shaft.

36. The hinge of claim 26 wherein the bias member comprises a block in which the sub-roller pin is held and a spring that urges the block and thus the sub-roller pin towards abutment with the main shaft.

37. The hinge of claim 26 further comprising in combination said hinge with a class plate shower door.

38. A hinge comprising:

first and second mounts;

a pivot pin positionable in the first and second mounts along a pivot axis;

a clamp to adjustably secure the pivot pin to and prevent rotation of the pivot pin relative to the first mount;

a generally v-shaped slot extending parallel to the pivot axis along a portion of the pin in the second mount;

a sub-roller pin held in the second mount and positioned in abutment with said portion of the pin;

biasing means biasing the sub-roller pin against said portion of the pin.

39. The hinge of claim 38 wherein the second mount includes a plate adaptable for mounting to a supporting structure.

40. The hinge of claim 38 wherein the second mount comprises a clamp that can clamp a door edge.

41. The hinge of claim 40 wherein the door is glass plate.

42. The hinge of claim 38 further comprising a second V-shaped slot extending parallel to the pivot axis along a portion of the pin in the second mount.

43. The hinge of claim 42 wherein the second V-shaped detent is positioned approximately 180 degrees opposite the V-shaped slot along the same part of the pivot pin.

44. The hinge of claim 38 further comprising a second detent positioned along the same part of the pivot pin but angularly displaced around the circumference of the pivot pin from the first V-shaped slot.

45. The hinge of claim 38 further comprising in combination said hinge with a glass plate shower door.

46. The hinge of claim 38 further comprising in combination said hinge and said shower door with a shower assembly.

47. A method of pivotally mounting a glass plate shower door at the top and bottom of the door to supporting structure comprising:

clamping first members to a periphery edge of the door at aligned positions on the top and bottom of the door;

securing second members to supporting structure defining the opening for the door at positions aligned with the first members when the door is in operative position relative to the opening;

forming an indexing detent along a longitudinal axis of indexing portions of top and bottom pivot pins;

positioning the top and bottom pivot pins between each first and second member with the indexing portions in the second members;

biasing a member at least partially into the indexing detents;

adjustably fixing other portions of the top and bottom pivot pins in the first members;

thereby aligning the indexing detents at the top and bottom of the door for simultaneous operation when pivoting the door without having to mount the second members in precise rotational orientation to the door, first members, or pivot pins.

48. The method of claim 47 further comprising a plurality of detents, positioned in the same relative position in both pivot pins.

49. The method of claim 48 wherein the plurality of detents comprise two detents positioned approximately 180 degrees apart around each pivot pin.

50. The method of claim 49 further comprising fixing the pivot pin against axial movement relative to the hinge.

51. The method of claim 48 further comprising a second member which is biased at least partially into a second detent in a said pivot pin.

52. The hinge of claim 47 further comprising in combination said hinge with a glass plate shower door.

53. The hinge of claim 47 further comprising in combination said hinge and said shower door with a shower assembly.

54. A hinge for a panel door comprising:

a mounting base to facilitate mounting of the mounting base to a supporting structure above or below a door;

a mounting member to facilitate mounting of the mounting member to a peripheral top or bottom edge of a door;

a pivot pin extending between and having portions in the mounting plate and the mounting member respectively and defining a pivot axis which is generally parallel with a plane defining a door;

a fixing mechanism in the the mounting member, the fixing mechanism fixing the pin in a selected rotational position in and disallowing rotational movement relative to the mounting member so that the pin rotates with the mounting member;

an indexing mechanism entirely in the mounting base, the indexing mechanism allowing indexable rotation of the portion of the pivot pin in the mounting base.

55. The hinge of claim 54 further comprising herein the mounting base included a mounting surface adapted for abuttment with a supporting structure, the mounting surface including an opening into the mounting base to a cavity therein, the cavity containing the indexing mechanism.

56. The hinge of claim 55 wherein the mounting member has an outer end surface including an opening to receive a pivot pin and all other exterior surfaces devoid of openings or adjustment mechanisms.

57. The hinge of claim 54 wherein the indexing mechanism comprises a biasing member having a first end in abuttment with an interior surface of a mounting base an opposite end urged into abuttment with pivot pin.

58. The hinge of claim 57 wherein the biasing member comprises a first and second members extending from opposite sides of the pivot pin into abuttment with the pivot pin.

59. The hinge of claim 54 wherein only the pivot pin in the mounting base rotates with the mounting member.

60. The hinge of claim 59 wherein the biasing member has an end in abuttment with the pivot pin comprising roller pin oriented along the longitudnial axis of the pivot pin and elongated for an elongated surface area of contact with the pivot pin.

61. The hinge of claim 54 further comprising in combination said hinge with a glass plate shower door.

62. The hinge of claim 54 further comprising in combination said hinge and said hower door with a shower assembly.

63. A hinge for a panel door comprising:

a mounting base to facilitate mounting of the mounting base to a supporting structure above or below a door;

a mounting member to facilitate mounting of the mounting member to a peripheral top or bottom edge of a door;

a pivot pin extending between and having portions in the mounting plate and the mounting member respectively and defining a pivot axis which is generally parallel with a plane defining a door;

a fixing mechanism in the mounting member, the fixing mechanism fixing the pin in a selected rotational position in and disallowing rotational movement relative to the mounting member so that the pin rotates with the mounting member;

an indexing mechanism in the mounting base, the indexing mechanism allowing indexable rotation of the portion of the pivot pin in the mounting base;

a bearing positioned between the mounting base and the mounting member, the bearing taking a substantial amount of the load of the hinge.

64. The hinge of claim 63 wherein the bearing is made of a plastic material.

65. The hinge of claim 63 wherein the bearing is fixed relative to the mounting member so that the bearing rotates relative to mounting base.

66. The hinge of claim 63 where in the mounting base includes a conical shaped opening in its surface adjacent a mounting member and bearing comprises a shape complimentary to the conical opening so that the bearing surface of the bearing is substantially conical surface to conical surface.

67. The hinge of claim 66 further comprising in combination an architectural structure.

68. The hinge of claim 67 further comprising in combination said hinge and said shower door with a shower assembly.

69. The hinge of claim 63 further comprising in combination said hinge with a glass plate shower door.

70. The hinge of claim 63 further comprising in combination said hinge and said shower door with a shower assembly.

* * * * *

UNITED STATES PATENT AND TRADEMARK OFFICE

CERTIFICATE OF CORRECTION

PATENT NO. : 6,161,255
DATED : December 19, 2000
INVENTOR(S) : Rodney G. Garrett It is certified that error appears in the above-identified patent and that said Letters Patent is hereby corrected as shown below:

Column 11, claim 37,
Line 49, delete [class] and insert -- glass --.

Column 13, claim 62,
Line 36, delete [hower] and insert -- shower --.

Signed and Sealed this

Sixth Day of November, 2001

*Attest:*

Nicholas P. Godici

NICHOLAS P. GODICI
*Acting Director of the United States Patent and Trademark Office*

*Attesting Officer*